United States Patent [19]

Jachowski et al.

[11] 4,365,997

[45] Dec. 28, 1982

[54] WEAR RESISTANT COMPOUND MATERIAL, METHOD FOR MANUFACTURING IT AND USE OF SUCH COMPOUND MATERIAL

[75] Inventors: Johannes Jachowski, Duisburg; Rudolf Mohs, Essen, both of Fed. Rep. of Germany

[73] Assignee: Fried. Krupp Gesellschaft mit beschränkter Haftung, Essen, Fed. Rep. of Germany

[21] Appl. No.: 147,626

[22] Filed: May 7, 1980

[30] Foreign Application Priority Data

May 15, 1979 [DE] Fed. Rep. of Germany ..... 2919477

[51] Int. Cl.[3] ..... B22F 3/00; B22F 5/00

[52] U.S. Cl. ..... 148/31; 164/59.1; 164/97; 75/240; 419/47

[58] Field of Search ..... 75/203, 204, 240; 164/57, 58, 59, 97

[56] References Cited

U.S. PATENT DOCUMENTS

| | | | |
|---|---|---|---|
| 2,828,202 | 3/1958 | Goetzel et al. | 75/203 |
| 3,247,557 | 4/1966 | Schmidt | 164/97 |
| 3,286,334 | 11/1966 | Hay | 164/97 |
| 3,561,934 | 2/1971 | Steven | 75/203 |
| 3,583,471 | 6/1971 | Kemming | 164/97 |
| 3,591,349 | 7/1971 | Benjamin | 75/203 |
| 3,600,163 | 8/1971 | Badia et al. | 164/97 |
| 3,723,077 | 3/1973 | Frehn | 75/203 |
| 3,871,058 | 3/1975 | Wallace | 164/97 |
| 4,207,096 | 6/1980 | Suwa et al. | 164/97 |

FOREIGN PATENT DOCUMENTS

| | | | |
|---|---|---|---|
| 1004142 | 9/1965 | United Kingdom | 75/203 |

*Primary Examiner*—Brooks H. Hunt
*Attorney, Agent, or Firm*—Spencer & Kaye

[57] ABSTRACT

A compound substance of great hardness and toughness, comprising a metal matrix, having embedded therein, hard material granules of a size of 0.1 to 5 mm. The metal matrix comprises 1 to 4% carbon, 0.3 to 0.6% silicon, 0.5 to 1.5% manganese, 0.8 to 2.8% vanadium, 0.5 to 1.5% chromium, 2 to 10% tungsten, about 0.01% aluminum and the remainder, iron.

15 Claims, 2 Drawing Figures

WEAR RESISTANT COMPOUND MATERIAL, METHOD FOR MANUFACTURING IT AND USE OF SUCH COMPOUND MATERIAL

BACKGROUND OF THE INVENTION

The present invention relates to a wear resistant compound material including a metal matrix in which a hard material is embedded. Hard materials include hard substances and hard metals. Hard substances are understood to mean carbides, nitrides, borides, silicides and oxides having a great hardness. Among the hard metals are Stellites, cast alloys based on Co-Cr-W-C-B, and hard metals based on tungsten carbide and/or titanium carbide or tantalum carbide, sintered with Co.

According to the prior art, it is the custom to armor machine parts which are subject to great wear with, among other things, deposition welded alloys in which the metal matrix formed by the welding electrode jacket has hard materials embedded in it. Such deposition welded alloys are applied in thin layers to the greatly stressed machine parts. However, these parts have the drawback that they can withstand only limited thermal and mechanical stresses and have only relatively short service lives. In order to increase service life, the deposition welded layers would have to be thickened, but this is not feasible because such thickened protective layers would be even more subject to loosening due to thermally caused mechanical stresses.

German Offenlegungsschrift [Laid-open Application] No. 2,630,932 discloses a compound substance made of a metal matrix with embedded hard material spheres. This compound substance is composed of hard metals containing 94 percent by weight WC and 6 percent by weight Co, or $W_2C$ hard substances and a metal matrix of sintered iron, sintered steel, cast iron or cast steel, the weight ratio of hard material to the metal matrix being 1:1 to 1:0.1.

It has been found, however, that such composite compound substances are unable to meet the demands of the uses to which they are put. The hard material spheres of a size of 2 to 10 mm easily break out of the metal matrix so that service life times cannot be substantially improved compared to the prior art deposition welded alloys. Moreover, the manufacture of the compound substance disclosed in German Offenlegungsschrift No. 2,630,932 is very difficult.

SUMMARY OF THE INVENTION

It is an object of the present invention to provide a wear-resistant compound substance containing a hard material in granular form embedded in a metal matrix.

It is a further object of the present invention to provide a compound substance of greater hardness and toughness, and resistance to abrasive wear, compared with prior art substances.

In view of these objects and in accordance with its purpose, the present invention provides a wear resistant compound substance and methods for its manufacture, the substance comprising a sintered or cast metal matrix including by weight, 1 to 4% carbon, 0.3 to 0.6% silicon, 0.5 to 1.5% manganese, 0.8 to 2.8% vanadium, 0.5 to 1.5% chromium, 2 to 10% tungsten, about 0.01% aluminum, and the remainder iron, and, embedded in the metal matrix, a hard material in granular form, the hard material having a grain size of 0.1 to 5 mm.

DETAILED DESCRIPTION OF THE INVENTION

Figure 1:
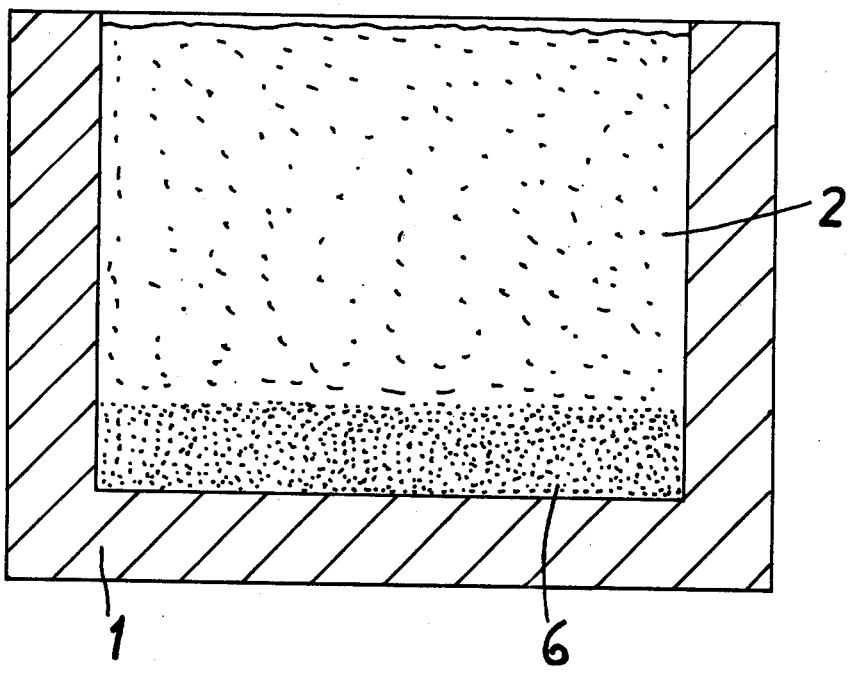
FIGS. 1 and 2 are schematic representations of casting molds according to the present invention, in cross section.

The present invention includes a novel compound substance and a method for its preparation. The substance which includes a metal matrix having hard material granules embedded therein, exhibits great hardness and toughness, and is useful as an abrasion resistant part.

Embodiments of the metal matrix of the present invention are sintered or cast, and comprise by weight, 1 to 4% carbon, 0.3 to 0.6% silicon, 0.5 to 1.5% manganese, 0.8 to 2.8% vanadium, 0.5 to 1.5% chromium, 2 to 10% tungsten, about 0.01% aluminum, and the remainder iron. According to a further embodiment of the invention, the metal matrix will comprise, by weight, 2.5 to 3.5% C, 0.4 to 0.5% Si, 0.8 to 1.2% Mn, 1.5 to 2.3% V, 0.8 to 1.2% Cr, 5 to 8% W, 0.01% aluminum and the remainder Fe.

In its broad embodiment, the metal matrix has embedded therein granules of a hard material having a grain size of 0.1 to 5 mm. In the further embodiment as described above, the grain size will generally be 0.5 to 1 mm. In accordance with the present invention, grain size ranges may also be 0.5–5 mm in the first embodiment described above, and 0.1–1 mm in the further embodiment above.

"Hard materials" as used herein refers to hard metals and to other hard substances, and to mixtures thereof.

The resisting substance to be utilized in the composition can be hard materials or hard metal alloys or combinations thereof. The hard components which are applicable with respect to the composition of the subject application are carbides, nitrides, borides, silicides, and oxides of the elements of Groups IIa, IIIa, IVa, IVb, Vb and VIb of the Periodic Table including such compounds as one or more of tungsten carbide, zirconium boride, titanium nitride, tantalum carbide, zirconium carbide, alumina, beryllium carbide, titanium carbide, silicon carbide, aluminum, boride, boron carbide, and mixtures thereof. The carbides of Groups IVb, Vb and VIb of the Periodic Table are preferred.

Among the hard metals useful in the present invention are Stellites® (Co-Cr-W alloys), cast alloys based on Co-Cr-W-C-B, and hard metals based on tungsten carbide and/or titanium carbides, or tantalum carbides, sintered with Co. Particularly useful are tungsten carbides of the WC or $W_2C$ type, titanium carbides, and/or tantalum carbides. Furthermore hard metal scrap is of great use in these compound substances. Such hard metal scrap components are often available in grain sizes of 0.5 to 5 mm as waste materials or scrap, from hard metal manufacturing facilities and can thus be subjected to economical further processing.

Hard substances include carbides nitrides, borides, silicides and oxides having great hardness.

The weight ratio of hard material grains to metal matrix is preferably 1:5, with respect to the initial weight of the components.

In another embodiment of the invention, the embedded hard metal is free of titanium.

In using these compound substances, it is advantageous for the metal matrix containing the hard material granules to be tightly bonded to a metal layer which does not contain any hard materials. In particular, this embodiment can easily be applied as a coating on a machine element which acts as a wear resistant layer.

The compound substance of the present invention may be manufactured by a process in which a metal alloy is melted and poured into a mold, preferably ceramic, and preferably preheated to about 800° to about 1200° C. Hard material grains, preferably of a size of 0.5 to 1 mm, are added to this melt, which is simultaneously quenched.

Due to their high specific weight, the hard material grains drop to the bottom of the mold, while the surfaces of the grains being to dissolve from exposure to the high temperature melt. An extremely favorable influence is exerted on structure of the compound substance produced if the mold is of the vibrating type, and the vibrations begin simultaneously with the addition of the granules. In this way, the hard material additive is uniformly distributed in the bottom of the metal matrix. By adjusting the metal matrix, it is possible to finely regulate the thickness of the wear-resistant compound layer.

In another method of manufacturing the compound bodies, the hard material grains are embedded in plastic matrix, the plastic being of a type which can be evaporated without residue. This plastic matrix is placed in the mold before the metal matrix is cast. When the hot, liquid metal is added to the mold, the plastic evaporates above the surface of the liquid metal, and the hard substance granules are simultaneously released, falling into the melt.

In a further embodiment of the method, the metal matrix with embedded hard material is soldered or welded to a metal free of hard material. This facilitates the application of the wearable compound substance as a wear resistant layer on particular machine parts.

These wear resistant parts may also be soldered or welded to tools which are subject to great abrasive wear, such as evacuation buckets and rock drilling bits.

The compound substances produced according to the present invention exhibit a great hardness and surprisingly a great toughness.

The invention will now be explained with regard to the preferred embodiments and with references to FIGS. 1 and 2.

Molded bodies of a size $35\times15\times100$ mm$^3$ are produced as compound substances according to the present invention. An alloy of the composition, by weight, of 3% C, 0.5% Si, 1% Mn, 1% Cr, 8% W, 1.6% V, 0.01% Al and the remainder Fe, is melted in an induction furnace. The melt, at 1520° C., is poured into ceramic mold 1, as shown in FIG. 1, which is heated to about 1000° C. A cast piece of dimensions $35\times100\times80$ mm$^3$ is produced. After completion of casting, hard metal additives grains 6, having a grain size of 0.5 to 1 mm, are added to melt 2 in the mold. Because of their higher specific weight, the hard metal grains sink to the bottom of the mold, their surfaces starting to dissolve due to the contact with the melt. At the same time, the mold is caused to vibrate so that a uniform distribution of the hard metal grains is realized at the bottom of the mold. The weight ratio of the metal melt to the hard material grains is 5:1.

Figure 2:
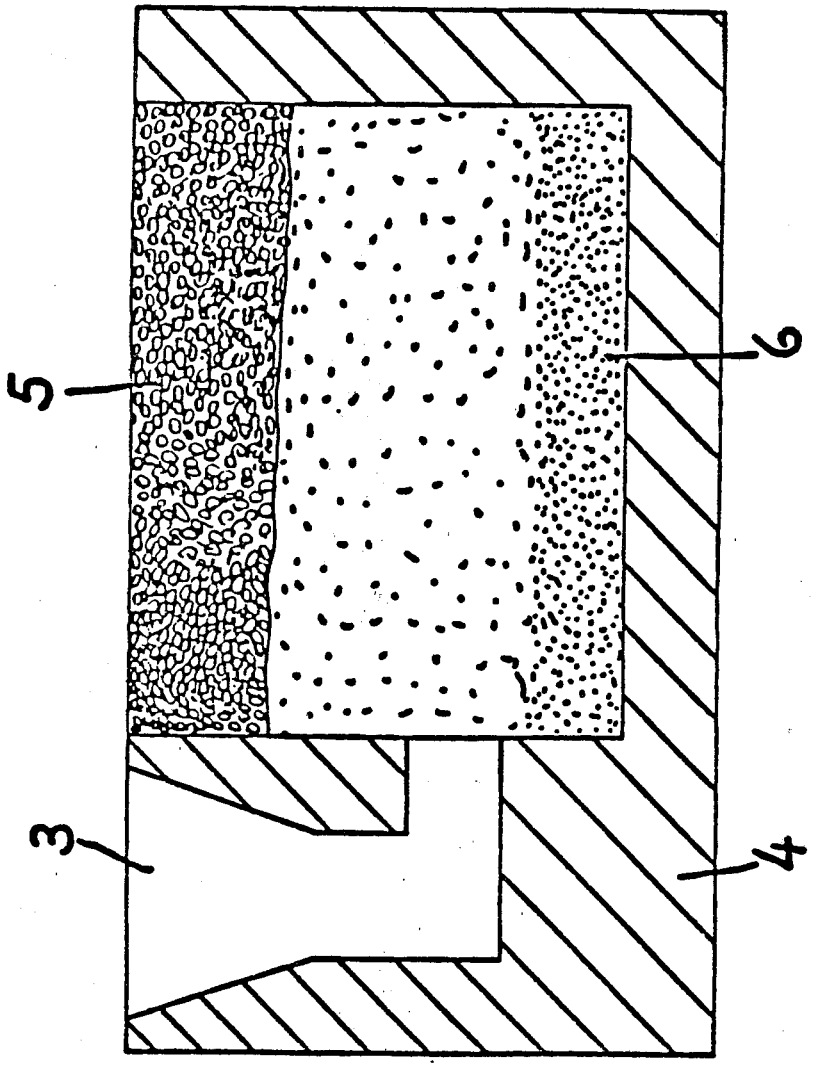

In the embodiment shown in FIG. 2, the melt is fed into a casting funnel 3 and flows in an ascending manner into a ceramic mold 4 while above the melt there is disposed a plastic matrix 5 which can be evaporated without residue and which contains a mixture of hard material grains.

This plastic matrix is incorporated into the mold which has been heated to 200° C. in such a manner that during casting and during evaporation of the plastic 5 the hard material grains 6 fall into the melt where they are uniformly distributed at the bottom of the metal matrix.

To obtain uniform introduction of the hard material granules into the melt, two factors are of substantial importance: (1) good wettability of the individual grains by the melt, and (2) proper balancing of the relationship of temperature and free melt surface to the weight and surface of the additive granules. Since the melt continuously loses heat, the addition of the granules must not take too long; however, too rapid addition may result in surface solidification of the melt, thus preventing uniform sinking of the hard material granules. The plastic matrix which evaporates without residue and which contains embedded granules, optimizes the addition of granular materials into the melt.

It will be understood that the above description of the present invention is susceptible to various modifications, changes and adaptations, and the same are intended to be comprehended within the meaning and range of equivalents of the appended claims.

We claim:

1. Wear resistant compound substance comprising a cast metal matrix comprising, by weight, 1 to 4% carbon, 0.3 to 0.6% silicon, 0.5 to 1.5% manganese, 0.8 to 2.8% vanadium, 0.5 to 1.5% chromium, 2 to 10% tungsten, about 0.01% aluminum, and the remainder, iron, and, embedded in said metal matrix, a hard material in granular form, the hard material having a grain size of 0.1 to 5 mm.

2. Compound substance as defined in claim 1 wherein said hard material has a grain size of 0.5 to 1 mm.

3. Compound substance as defined in claim 1 wherein the metal matrix comprises, by weight, 2.5 to 3.5% carbon, 0.4 to 0.5% silicon, 0.8 to 1.2% manganese, 1.5 to 2.3% vanadium, 0.8 to 1.2% chromium, 5 to 8% tungsten, 0.01% aluminum, and the remainder iron.

4. Compound substance as defined in any one of claims 1 through 3 wherein the metal matrix having said hard material embedded therein, is tightly bonded to a metal layer free of hard materials.

5. Compound substance as defined in any one of claims 1 through 3, wherein the hard material is selected from the group consisting of tungsten carbide of the type WC, tungsten carbide of the type $W_2C$, titanium carbides, tantalum carbides, and mixtures thereof.

6. Compound substance as defined in any one of claims 1 through 3, wherein the embedded hard material is free of titanium.

7. Compound material as defined in any one of claims 1 through 3 wherein the weight ratio of hard material to metal matrix, based on initial weights, is 1:5.

8. Compound substance as defined in any one of claims 1 through 3 which is welded onto a tool subject to abrasive wear.

9. Compound substance as defined in claim 8 wherein the tool is an excavating bucket or a rock drilling bit.

10. Method for producing a compound substance comprising melting an alloy comprising, by weight, 1 to 4% carbon, 0.3 to 0.6 silicon, 0.5 to 1.5% manganese, 0.8 to 2.8% vanadium, 0.5 to 1.5 chromium, 2 to 10% tungsten, about 0.01% aluminum, and the remainder, iron, pouring said melt into a mold, adding to said melt hard material granules having a size of 0.1 to 5 mm, the hard material being embedded in a plastic matrix comprising a plastic which evaporates without residue, and simultaneous with said addition, cooling said melt.

11. Method as defined in claim 10 wherein the mold is a preheated ceramic mold.

12. Method as defined in claim 10 or 11 wherein the mold is preheated to about 800° C. to about 1200° C.

13. Method as defined in claim 10 or 11 additionally comprising soldering or welding the compound substance onto a metal layer free of hard materials.

14. Method as defined by claim 10 wherein the mold is vibrated to uniformly distribute the hard material in the bottom of the metal matrix.

15. The method as defined in claim 10 or 14, wherein the plastic matrix is placed in the mold before the metal alloy is poured into the mold, and when the melt is added to the mold, the plastic evaporates above the surface of the melt, and the hard substance granules are simultaneously released, falling into the melt.

* * * * *